United States Patent [19]

Imamura et al.

[11] 4,164,307

[45] Aug. 14, 1979

[54] CAP WITH SUPPLY STOPPER FOR USE WITH CONTAINERS

[75] Inventors: Masanaga Imamura; Hisashi Sakai; Hiroaki Sugiyama; Seiji Ozawa, all of Tokyo, Japan

[73] Assignee: Ricoh Company Limited, Tokyo, Japan

[21] Appl. No.: 790,323

[22] Filed: Apr. 25, 1977

[30] Foreign Application Priority Data

May 4, 1976 [JP] Japan ..... 51-54953[U]

[51] Int. Cl.[2] ..... B65D 47/12

[52] U.S. Cl. ..... 222/182; 222/501; 222/518; 222/545

[58] Field of Search ..... 222/153, 182, 402.11, 222/501, 518, 545; 137/233, 234; 401/262, 264, 190

[56] References Cited

U.S. PATENT DOCUMENTS

| | | | |
|---|---|---|---|
| 1,415,407 | 5/1922 | Schweinert et al. | 137/234 |
| 1,666,562 | 4/1928 | Gits | 137/233 |
| 1,968,965 | 8/1934 | Smith | 137/234 |
| 2,214,218 | 9/1940 | Aiken | 222/501 |
| 2,337,276 | 12/1943 | Sanchis | 222/501 X |
| 2,703,665 | 3/1955 | Soffer et al. | 222/402.11 |
| 3,343,201 | 9/1967 | Cox et al. | 401/190 |

*Primary Examiner*—Francis J. Bartuska

*Attorney, Agent, or Firm*—Blanchard, Flynn, Thiel, Boutell & Tanis

[57] ABSTRACT

A cap with a supply stopper for use with ordinary containers comprising a detachable double cap, that is, an outer cap and an inner cap which is used as a supply cap having a supply opening and a supply stopper. By an engagement mechanism of the upper cap and the inner cap, when the upper cap is fastened, the supply stopper is firmly pressed against the supply opening so that the leakage of contents in the container during storage or transportation is completely prevented.

4 Claims, 7 Drawing Figures

CAP WITH SUPPLY STOPPER FOR USE WITH CONTAINERS

BACKGROUND OF THE INVENTION

This invention relates in general to a cap for use with containers for fluids, and more particularly involves a screw cap with a liquid supply stopper for use with containers for fluid substances including powders.

In the conventional containers for liquids, such as liquid developers, other liquid chemicals and liquid fuels, an ordinary screw cap is often used during transportation and storage, and when the liquid in the container is used, the screw cap is exchanged with a cap having a liquid supply stopper.

The conventional cap having a liquid supply stopper comprises a cap with a liquid supply opening, and a stopper having a rod passing through the liquid supply opening and projecting out of the opening, the stopper being disposed inside the cap and in pressure contact with the opening when not in use so as to shut the opening tightly by spring means connecting a support member of the rod with a support member fixed inside the cap.

When the liquid in the container is used, the container with the cap having a liquid supply stopper is turned upside down and the projecting rod is pushed against the resilience of the spring means in the cap, for example, by pushing the top of the rod against the bottom of a receiving container so as to space the liquid supply stopper from the liquid supply opening. Thus, the liquid flows out through the liquid supply opening.

Therefore, two different types of caps, namely, an ordinary screw cap and a cap having a liquid supply stopper, are used in the conventional liquid container.

However, the ordinary screw cap is apt to be loosened by vibrations or changes in temperature and atmospheric pressure or the like during storage or transportation, in particular, during air transportation, causing leakage of the liquid.

Moreover, as mentioned previously, when the liquid in the container is used, the screw cap has to be exchanged with the cap having a liquid supply stopper. At that time, unexpected accidents are apt to occur, such as turning over the container, the liquid being scattered by the slightest shock, smearing the clothes of a person who handles the container. In particular, such accidents are very dangerous in case the liquid is corrosive.

In the case of the conventional cap for use with the containers for powders, the above mentioned problems occur likewise.

SUMMARY OF THE INVENTION

It is, therefore, an object of this invention to provide a cap having two functions as a screw cap which is not loosened during storage and transporation and as a cap having a supply stopper so as to obviate the inconveniences of using and exchanging two different types of caps for use with containers.

Another object of this invention is to provide a cap which ensures safety in storage, transportation and handling of containers.

According to the present invention, there is provided a cap comprising a double cap, that is, an outer cap and an inner cap, the inner cap having a function as a cap with a supply stopper, and in this invention, when the outer cap is fastened, the supply stopper is pressed firmly over the supply opening of the inner cap by the connecting mechanism which connects the inner cap and the outer cap so that the leakage of contents during storage or transportation is completely obviated, and when the contents are used, only by unfastening the outer cap, the contents can be used in the same manner as in the containers with the conventional cap having a supply stopper.

BRIEF DESCRIPTION OF THE DRAWINGS

FIG. 1 is a partially sectional view of an inner cap of the embodiment of this invention.

FIG. 2 is a cross-sectional view of an outer cap of the embodiment of this invention.

FIG. 3 is a cross-sectional view of the fitting condition of the outer cap and the inner cap of the embodiment of this invention.

FIG. 4 is a perspective view of an inner cap of the second embodiment of this invention.

FIG. 5 is a perspective view of an outer cap, partly in section, of the second embodiment of this invention.

FIG. 6 is a cross-sectional view of the fitting condition of the outer cap and the inner cap of the second embodiment of this invention.

DETAILED DESCRIPTION OF PREFERRED EMBODIMENTS

Figure 1:
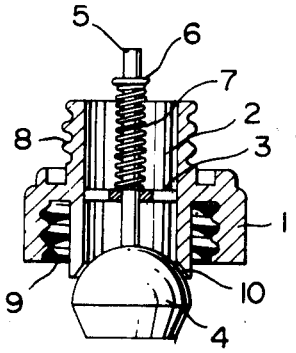
FIGS. 1–3 illustrate the first preferred embodiment according to the present invention.
Figure 2:
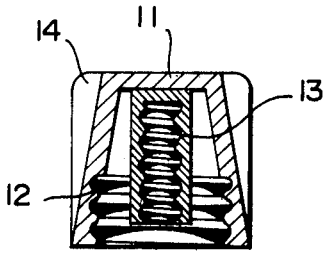
Figure 3:
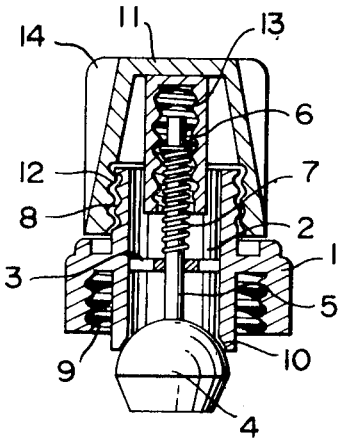

FIGS. 1–3 illustrate the first preferred embodiment according to the present invention.

FIG. 1 is a partially sectional view of an inner cap of the first embodiment of this invention. The inner cap 1 has a supply opening 2 in the center of the inner cap 1. Inside the inner cap 1 is fixed a support member 3, through which a rod 5 having a supply stopper 4 at one end thereof is passed. At the other end portion of the rod 5 is fixed a disc 6. Spring means 7 is connected between the support member 3 and the disc 6 so that the supply stopper 4 is pressed tightly against the supply opening 2 by the resilience of spring means 7.

The numeral 8 is a screw fitting portion of the inner cap 1, which fits in the screw fitting portion 12 of an outer cap 11 in FIG. 2. The numeral 9 is a screw fitting portion of the inner cap 1 which fits in the screw fitting portion of a container in general use.

The numeral 10 is a portion where the supply opening 2 and the supply stopper 4 are brought into close contact with each other.

FIG. 2 is a cross-sectional view of the outer cap 11 of the first embodiment of this invention.

The outer cap 11 is fastened at the screw fitting portion 12 and a screw fitting portion 8 of the inner cap 1.

At the inside center of the outer cap 11 is provided a screw socket 13. The pitch of the screw thread of the screw socket 13 is a little greater than that of the screw threads of the screw fitting portions 12 and 8, respectively, of the outer cap 11 and the inner cap 1.

On the outer cap 11 is provided a nonskid 14 to prevent skidding when the outer cap 11 is screwed.

The operation mechanism of the inner cap 1 and the outer cap 11 is as follows:

As shown in FIG. 3, the inner cap 1 is screwed at the screw fitting portion 9 of the supply opening 2 of an ordinary container. At this time, the supply stopper 4 is being tightly pressed against the close contact portion 10 of the supply opening 2 by the resilience of spring means 7 connected between the disc 6 fixed at the end portion of the rod 5 and the support member 3. Then, the outer cap 11 is screwed so that the screw fitting portion 12 is fitted in the screw fitting portion 8 of the inner cap 1. At this time, the disc 6 fixed at the rod 5 is screwed into the screw socket 13. As the outer cap 11 is screwed, the disc 6 is screwed into the screw socket 13 as well. Therefore, the rod 5 is pulled outwards by the disc 6 and accordingly, the supply stopper 4 fixed at the lower end of the rod 5 is also pulled in the same direction, resulting in that the supply stopper 4 is brought into closer contact with the close contact portion 10.

Since the pitch of the screw thread of the screw socket 13 is greater than that of the screw threads of the screw fitting portions 12 and 8, the supply stopper 4 is brought into much closer contact with the close contact portion 10 as the outer cap 11 is screwed.

When the contents in the container are used, the outer cap 11 is unscrewed and detached and the container with the inner cap 1 is turned upside down and the top of the projecting rod 5 is pushed against the resilience of spring means 7 in the inner direction of the container, for instance, by pushing the rod 5 against the bottom of a receiving container. Thus, the supply stopper 4 is unfitted from the supply opening 2 and thus the content flows out through the liquid supply opening 2.

Figure 5:
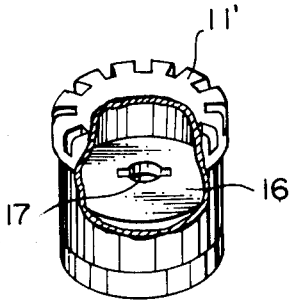
FIGS. 4–6 illustrate the second preferred embodiment according to this invention.
Figure 4:
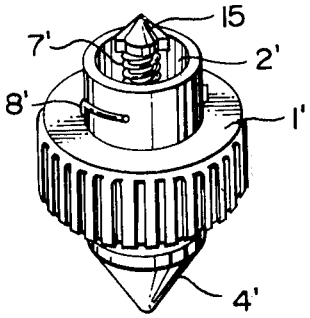
Figure 6:
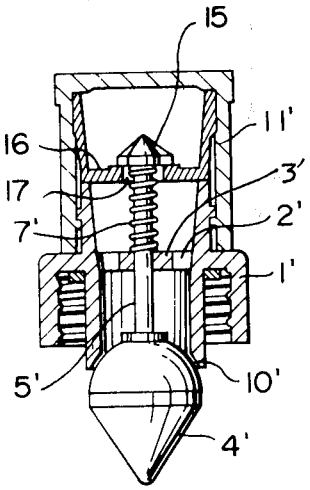

FIGS. 4–6 illustrate the second preferred embodiment according to the present invention.

FIG. 4 is a perspective view of an inner cap 1′ with a supply stopper 4′. The inner cap 1′ has a supply opening 2′ in the center of the inner cap 1′. Inside the inner cap 1′ is fixed a support member 3′, through which a rod 5′ having the supply stopper 4′ at one end thereof is passed. At the other end of the rod 5′ is provided a fixing head 15. Spring means 7′ is connected between the support member 3′ and the fixing head 15 in the manner that the resilience of spring means 7′ is generated. The fixing head 15 is conic and has a pair of projecting parts at both sides thereof.

The axially outer wall of the inner cap 1′ has an externally projecting, circumferentially extending, axially inclined guide tooth 8′ which engages a corresponding guide tooth inside the outer cap 11′. In the second embodiment, the outer cap 11′ fixedly engages with the inner cap 1′ through the guide tooth by the turn of 90 degrees. The axial incline of the guide teeth acts to draw the outer cap 11′ axially inwardly relative to the inner cap 1′ when the outer cap 11′ is turned the 90 degrees.

FIG. 5 shows the outer cap 11′. Inside the outer cap 11′ is provided a shelf 16. In the center of the shelf 16 is a hole 17 which permits passing of the fixing head 15.

FIG. 6 is a cross-sectional view of the fitting condition of the inner cap 1′ and the outer cap 11′.

In FIGS. 4–6, the identical parts are given the identical numerals.

In this embodiment, when the outer cap 11′ is put on the inner cap 1′, the fixing head 15 of the inner cap 1′ appears from the shelf 16, passing through the hole 17 of the outer cap 11′. Under such condition, the outer cap 11′ is turned by 90 degrees. Then, the outer cap 11′ is firmly fitted with the inner cap 1′ by the engagement of the guide tooth 8′ with the corresponding guide tooth inside the outer cap 11′.

At this time, the hole 17 of the shelf 16 is also turned by 90 degrees. This results in that a pair of the projecting parts of the fixing head 15 are caught by the circular edges of the hole 17 and at the same time, the fixing head 15 is pulled outwards because the axially outer wall of the inner cap 1′ pushes the shelf 16 axially outwardly as the guide teeth draw the outer cap 11′ axially inwardly relative to the axially outer wall of the inner cap 1′.

Therefore, the supply stopper 4′ is also pulled outwards through the rod 5′ so that the supply stopper 4′ is more closely fitted into the close contact portion 10′ of the supply opening 2′.

Figure 7:
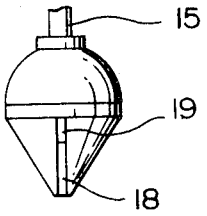
FIG. 7 is a side view of a preferred supply stopper having a groove and a projecting member which can be used in any of the above mentioned embodiments according to the present invention.

FIG. 7 is a front view of a preferred supply stopper which can be used in any of the above mentioned embodiments according to the present invention.

At the lower outside portion of the supply stopper are provided a groove 18 and a projecting member 19. Inside a container are also provided a projecting member and a groove, which fit in the groove 18 and the projecting member 19, respectively.

When this supply stopper is incorporated in the first or second embodiment, and the rod 5 in FIG. 1 or the rod 5′ in FIG. 4 is pulled outwards by screwing the outer cap, with these grooves and projecting members fitted, the pulling action of the rod or the fixing head can be ensured without rotating the rod in FIG. 1 or FIG. 4.

What is claimed is:

1. A closure for a container, comprising:

an inner cap having attachment means for releasably attaching said inner cap to a container, said inner cap having centrally located supply opening means and a valve seat located at the inner end of said supply opening means;

a reciprocable valve element sealingly engageable with said valve seat, an operating rod extending outwardly from said valve element through said supply opening means and resilient means located in said supply opening means outwardly from said valve element for urging said rod outwardly to urge said valve element into sealing engagement with said valve seat, said operating rod being movable against the urging of said resilient means to move said valve element away from said valve seat whereby to permit dispensing of the contents of said container;

an outer cap mounted on said inner cap for closing the outer end thereof, said outer cap having first interengaging means rotatably engaged with corresponding means on said inner cap for releasably retaining said outer cap in position on said inner cap, said outer cap also having second interengaging means separate from said first interengaging means and interengaged with said operating rod for positively mechanically moving said operating rod outwardly in response to rotation of said outer cap relative to said inner cap whereby to move said valve element into tighter sealing engagement with said valve seat.

2. A closure according to claim 1, in which said attachment means on said inner cap comprises a cylindrical internally threaded wall adapted for threadedly engaging mating screw threads on the container, said inner cap having a transversely extending base wall at the axially outer end of said internally threaded wall, a cylindrical axially inner wall extending axially inwardly from said base wall in axially overlapping, radially inwardly spaced relationship with said internally threaded wall so that said axially inner wall is adapted to extend into the interior of the container, said axially inner wall having said valve seat at its axially inner end, said inner cap having a cylindrical axially outer wall extending axially outwardly from said base wall, said axially outer wall and said axially inner wall of said inner cap defining said centrally located supply opening means, said axially outer wall also having external circumferentially extending axially inclined projection means thereon, said reciprocable valve element being disposed axially inwardly from said valve seat, said resilient means being coil spring means encircling said operating rod, said outer cap having a cylindrical external wall surrounding said axially outer wall of said inner cap, said first interengaging means comprising internal circumferentially extending axially inclined projection means on said external wall and interengaged with said external projection means on said axially outer wall of said inner cap to that said outer cap can be rotated relative to said inner cap so as to move inwardly and outwardly relative thereto, said second interengaging means on said outer cap being interengaged with said operating rod so that rotation of said outer cap to move same axially inwardly relative to said inner cap pulls said operating rod axially outwardly relative to said inner cap wherey to pull said valve element more tightly against said valve seat.

3. A closure as claimed in claim 2 in which said outer cap is an inverted generally cup-shaped member having an internal screw thread defining said internal projection means thereon, the external projection means on said axially outer wall of said inner cap being defined by an external screw thread which is threadedly engaged with said internal screw thread of said outer cap;

said outer cap having an internally threaded screw socket projecting axially inwardly from the axially outer wall of said outer cap into said centrally located supply opening means in said inner cap, said operating rod having a part threadedly interengaged with the internal threads of said screw socket, the pitch of the screw thread of said screw socket being slightly greater than the pitch of the interengaging screw threads of the inner and outer caps to that as said outer cap is screw threaded onto said inner cap, said operating rod is pulled outwardly by the screw threaded engagement of said part with the internal screw threads of said socket.

4. A closure as claimed in claim 2 in which said outer cap is an inverted generally cup-shaped member having a transversely extending shelf extending thereacross between its axially outer and axially inner ends, said cup-shaped member having an internal guide tooth defining said internal projection means thereon and located axially inwardly of said shelf, said shelf having a centrally located hole therethrough which hole is elongated in one transverse direction and is narrow in the direction perpendicular thereto;

said external projection means on said axially outer wall of said inner cap being defined by an external guide tooth which is threadedly engaged with said internal guide tooth of said outer cap so that said outer cap can be rotated through an angle of about 90 degrees relative to said inner cap, said operating rod having a transversely elongated head capable of passing through the elongated portion of said hole but incapable of passing through the narrow portion of said hole, said head being movable through said hole when said outer cap is initially positioned so that the elongated extent of said hole is axially aligned with said elongated head, said heat bearing against the axially outer side of said shelf when said outer cap has been rotated from the initial position through said angle of about 90 degrees relative to said inner cap to a second position, said head and thereby said operating rod being pulled axially outwardly as said outer cap is rotated from said initial position to said second position.

* * * * *

UNITED STATES PATENT AND TRADEMARK OFFICE

CERTIFICATE OF CORRECTION

PATENT NO. : 4 164 307

DATED : August 14, 1979

INVENTOR(S) : Masanaga Imamura et al

It is certified that error appears in the above-identified patent and that said Letters Patent are hereby corrected as shown below:

Column 5, line 20; change "to" to ---so---.

Column 5, line 27; change "wherey" to ---whereby---.

Column 6, line 5; change "to" to ---so---.

Column 6, line 33; change "heat" to ---head---.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*